US007130177B2

(12) United States Patent
Aizawa et al.

(10) Patent No.: US 7,130,177 B2
(45) Date of Patent: Oct. 31, 2006

(54) DRIVE CIRCUIT OF SWITCH AND RELAY CIRCUIT

(75) Inventors: Yoshiaki Aizawa, Kanagawa (JP); Masayuki Sonoda, Fukuoka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 190 days.

(21) Appl. No.: 11/006,681

(22) Filed: Dec. 8, 2004

(65) Prior Publication Data

US 2005/0168793 A1 Aug. 4, 2005

(30) Foreign Application Priority Data

Dec. 9, 2003 (JP) ..... 2003-410692

(51) Int. Cl.
*H01H 59/00* (2006.01)

(52) U.S. Cl. ..... 361/207

(58) Field of Classification Search ..... 361/207
See application file for complete search history.

(56) References Cited

U.S. PATENT DOCUMENTS 5,013,926 A * 5/1991 Aizawa ..... 250/551
5,514,996 A * 5/1996 Aizawa ..... 327/514
6,546,798 B1 4/2003 Waters et al.
6,604,641 B1 8/2003 Wolf et al.
6,636,653 B1 10/2003 Miracky et al.
6,884,950 B1 * 4/2005 Nicholson et al. ..... 200/181
7,030,416 B1 * 4/2006 Kitagawa et al. ..... 257/79
2004/0061106 A1 4/2004 Kitagawa et al.
2004/0124339 A1 * 7/2004 Kato et al. ..... 20/214 R

FOREIGN PATENT DOCUMENTS

JP 2002-236265 8/2002

* cited by examiner

*Primary Examiner*—Stephen W. Jackson
*Assistant Examiner*—Ann T. Hoang
(74) *Attorney, Agent, or Firm*—Oblon, Spivak, McClelland, Maier & Neustadt, P.C.

(57) ABSTRACT

A drive circuit and relay circuit using this drive circuit are provided, the drive circuit including: a first terminal connected to a drive electrode located at one side of a mechanical switch contact driven by static electricity; a second terminal connected to a drive electrode located at the other side of the switch contact; a photoelectromotive force element connected to the first terminal and the second terminal, optically coupled to a light emitting element, and including at least two photodiode arrays which are serially connected; and an electronic inductor circuit (bypass circuit) connected in parallel with at least one of the photodiode arrays in the photoelectromotive force element.

20 Claims, 4 Drawing Sheets

DRIVE CIRCUIT OF SWITCH AND RELAY CIRCUIT

CROSS-REFERENCE TO RELATED APPLICATION

This application is based upon and claims the benefit of priority from prior Japanese Patent Application No. 2003-410692, filed on Dec. 9, 2003, the entire contents of which are incorporated herein by reference.

BACKGROUND OF THE INVENTION

1. Field of the Invention

The present invention relates to a drive circuit of a switch and a relay circuit.

2. Background Art

Conventionally, mechanical relays and photo relays have been used as switching devices. Recently, devices having mechanical contacts driven by static electricity, in particular MEMS (Micro-Electro-Mechanical System) relays which have switch contacts using MEMS, are attracting attention as such switching devices, as disclosed in, e.g., Japanese Patent Laid-Open Publication No. 2002-236265. Since MEMS switches used in such MEMS relays are small in size and light in weight, they can operate at a high switching frequency. In particular, MEMS switches driven by static electricity are faster in displacement rate and lower in power consumption than MEMS switches driven by heat. For this reason, MEMS relays using MEMS switches driven by static electricity are attracting attention as key devices of mobile terminals, for which low power consumption is required, wireless antennas, for which low insertion loss is required, high-speed wireless communication, for which high-frequency characteristics are required, etc.

In MEMS switches that are driven by static electricity, a high voltage is necessary to generate an electrostatic force sufficient for driving a contact. For this reason, in order to obtain a reliable switching performance, the electrostatic driving requires a high voltage, which makes it difficult to decrease the size and the cost of the drive circuit (relay circuit).

In order to solve this problem, the present inventors have studied a method of using a photoelectromotive force produced by a photodiode array to generate a voltage necessary to drive an MEMS switch. In this method of using a photoelectromotive force produced by a photodiode array, small photodiodes are connected in series, and a high voltage can be obtained by increasing the number of the photodiodes connected in series. A drive circuit which is smaller in size and lower in cost can be obtained in this manner.

As described above, devices having mechanical contacts driven by static electricity, in particular MEMS relays including switch contacts using MEMS, are attracting attention as switching devices which are superior in high-frequency characteristics, etc. However, unlike contacts using semiconductor devices such as MOSFETs, etc., mechanical switch contacts are mechanical reed type contacts. Accordingly, there is a problem in that the long-term reliability and lifetime of a MEMS relay are inferior to those of a semiconductor device. In particular, one of the most critical problems that shorten the lifetime of an MEMS switch is a movable part sticking to a substrate. The cause of this problem has not been clarified sufficiently.

Such a problem of limited lifetime also occurs in the aforementioned switching device that the present inventors have studied, which is manufactured by combining an MEMS switch driven by static electricity and a relay circuit using a photodiode array. In order to solve this problem of limited lifetime, the present inventors have conducted various studies and analyses.

SUMMARY OF THE INVENTION

A drive circuit of a switch which is mechanical and driven by static electricity according to a first aspect of the present invention includes:

a photoelectromotive force element array connected between a first output terminal and a second output terminal connected to the switch, the photoelectromotive force element array including a first array unit and a second array unit, which are serially connected with each other, each of the first array unit and the second array unit having one or more photoelectromotive force elements serially connected, each photoelectromotive force element receiving light to generate a photoelectromotive force; and a bypass circuit connected between the first output terminal and a connection point of the first array unit and the second array unit for bypassing the second array unit to connect the first output terminal and the second output terminal via the first array unit, the bypass circuit being connected between the first output terminal and the connection point so as to be in parallel with the second array unit, and short-circuiting the first output terminal and the connection point a predetermined period of time after the photoelectromotive force is applied from the second array unit.

A relay circuit according to a second aspect of the present invention includes:

a switch, which is mechanical and driven by static electricity; and a drive circuit including a first output terminal and a second output terminal, the switch being connected between the first output terminal and the second output terminal, the drive circuit comprising:

a photoelectromotive force element array including a first array unit and a second array unit, which are serially connected with each other, each of the first array unit and the second array unit having one or more photoelectromotive force elements serially connected, each photoelectromotive force element receiving light to generate a photoelectromotive force; and a bypass circuit connected between the first output terminal and a connection point of the first array unit and the second array unit for bypassing the second array unit to connect the first output terminal and the second output terminal via the first array unit, the bypass circuit being connected between the first output terminal and the connection point so as to be in parallel with the second array unit, and short-circuiting the first output terminal and the connection point a predetermined period of time after the photoelectromotive force is applied from the second array unit.

A relay circuit according to a third aspect of the present invention includes:

a light-emitting element connected to a pair of input terminals, and emitting light by passing a current between the pair of input terminals;

a switch, which is mechanical and driven by static electricity; and a drive circuit including a first output terminal and a second output terminal, the switch being connected between the first output terminal and the second output terminal, the drive circuit comprising:

a photoelectromotive force element array including a first array unit and a second array unit, which are serially connected with each other, each of the first array unit and the second array unit having one or more photoelectromotive force elements serially connected, each photoelectromotive force element receiving light to generate a photoelectromotive force; and a bypass circuit connected between the first output terminal and a connection point of the first array unit and the second array unit for bypassing the second array unit to connect the first output terminal and the second output terminal via the first array unit, the bypass circuit being connected between the first output terminal and the connection point so as to be in parallel with the second array unit, and short-circuiting the first output terminal and the connection point a predetermined period of time after the photoelectromotive force is applied from the second array unit.

DESCRIPTION OF THE EMBODIMENTS

Before embodiments of the present invention are described in detail, a switching device which is the basis of the present invention will be described below with reference to FIG. 4.

Figure 4:
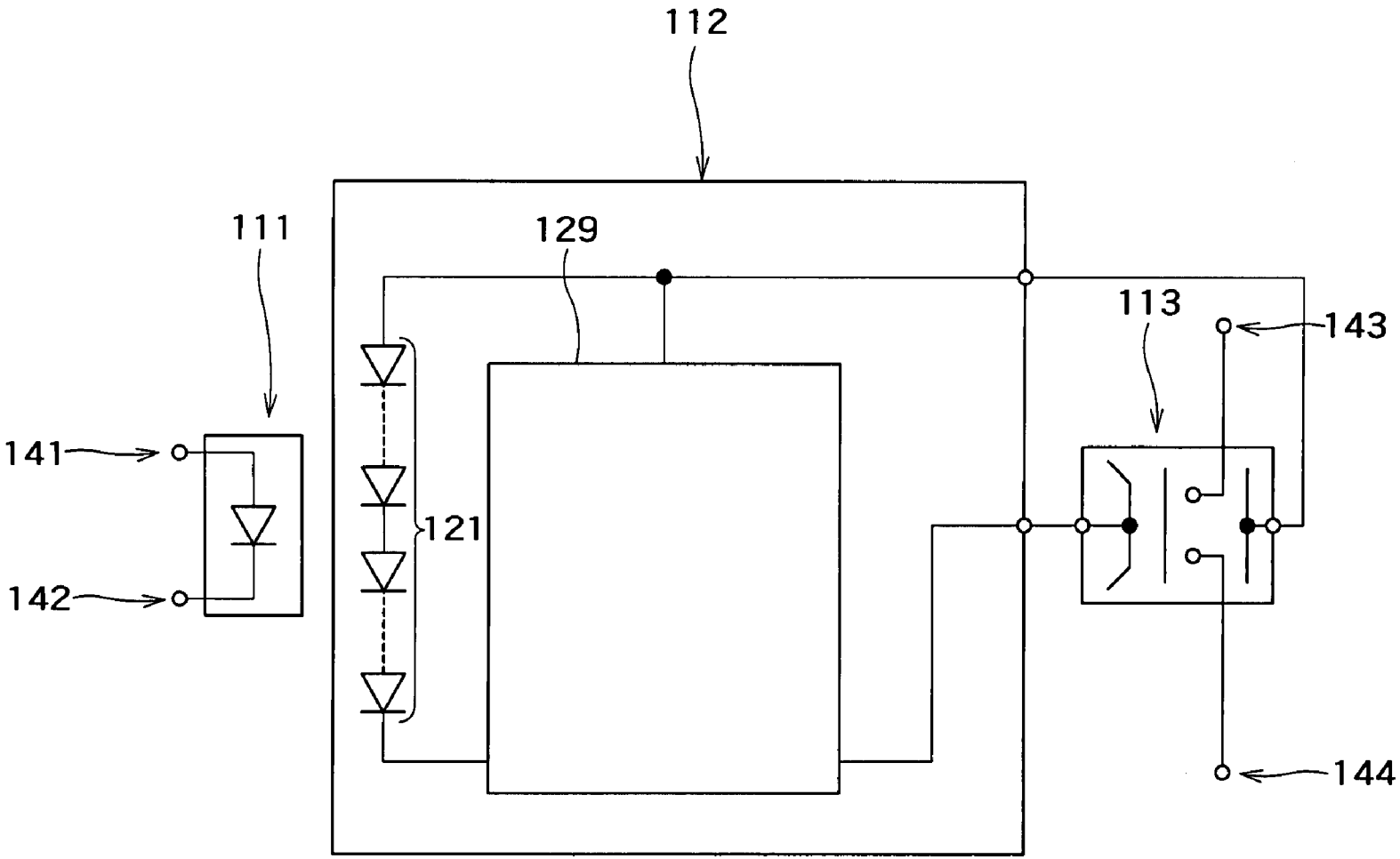
FIG. 4 is a drawing showing another switching device made by the present inventors.

FIG. 4 is a drawing showing a switching device, which the present inventors have developed. The switching device includes an LED (Light Emitting Diode) 111 connected to a pair of input terminals 141 and 142, a drive circuit (relay circuit) 112, and a mechanical switch contact 113 connected to a pair of output terminals 143 and 144 and driven by static electricity. In this device, the relay circuit 112 is located so as to be capable of receiving light from the LED 111. The relay circuit 112 receives light from the LED 111, generates a photoelectromotive force by using a photodiode array 121, and drives the mechanical switch contact 113. The relay circuit 112 includes a predetermined discharging circuit 129. The switch contact 113 driven by the relay circuit 112 is a switch contact using MEMS, which requires a high voltage at the time of activation. In the device shown in FIG. 4, a photoelectromotive force caused by the photodiode array 121 is used to generate a high voltage.

In the switching device shown in FIG. 4, the LED 111 emits light when an input current flows through the pair of input terminals 141 and 142. The photodiode array 121 receives the light from the LED 111 to generate the photoelectromotive force, which is applied to the mechanical switch contact 113 to turn it on, thereby turning on the pair of output terminals 143 and 144. When the LED 111 is turned off, the supply of photoelectromotive force from the photodiode array 121 is stopped to turn off the mechanical switch contact 113, thereby turning off the pair of output terminals 143 and 144. Because the discharging circuit 129 is provided, when the circuit is turned off, the recovery time of the switch contact 113 can be shortened. In the device of FIG. 4, the switching between an ON state and an OFF state is performed in this manner.

One of the characteristic features of the switching device shown in FIG. 4 lies in that the mechanical contact 113 driven by static electricity is activated by a photoelectromotive force of the photodiode array 121. It is possible to easily generate a high voltage by increasing the number of small photodiodes connected in series, which constitute the photodiode array 121. Accordingly, in the device of FIG. 4, the size of the relay circuit 112 can be decreased to about 1 mm×1 mm. Furthermore, it is possible to decrease the cost for manufacturing the relay circuit 112. Moreover, since the mechanical switch contact 113 uses MEMS driven by static electricity, it is possible to manufacture a device superior in high-frequency characteristic.

However, like a conventional switch contact using MEMS, the switching device of FIG. 4 has a problem of short lifetime. A particularly large problem is a phenomenon in which a contacting portion of the contact 113 is bonded and immobilized (sticking problem). The present inventors have performed various experiments to study the causes of the short lifetime. As a result, the present inventors have found the following cause.

The switch contact 113 using MEMS shown in FIG. 4, which is driven by static electricity, requires a high voltage at the time of activation. The high voltage is mainly required at an initial operation stage when the switch is turned on. However, in the switching device shown in FIG. 4, the voltage applied to the switch contact 113 is always kept high. Accordingly, the high voltage applied in the initial stage remains applied after the switching operation is completed. In such a state, the mechanical switch contact 113 is pressed by a strong force caused by the high voltage for a long period of time, and eventually the contacting portion of the contact 113 is bonded by atomic force. This is deemed to be a main reason for the occurrence of sticking, which shortens lifetime.

Based on the aforementioned analysis, the present inventors decided to improve the relay circuit 112 to curb the occurrence of sticking and to increase the lifetime of the mechanical switch contact 113. Hereinafter, embodiments of the present invention will be described based on the aforementioned facts. Hereinafter, three embodiments will be described.

[First Embodiment]

Figure 1:
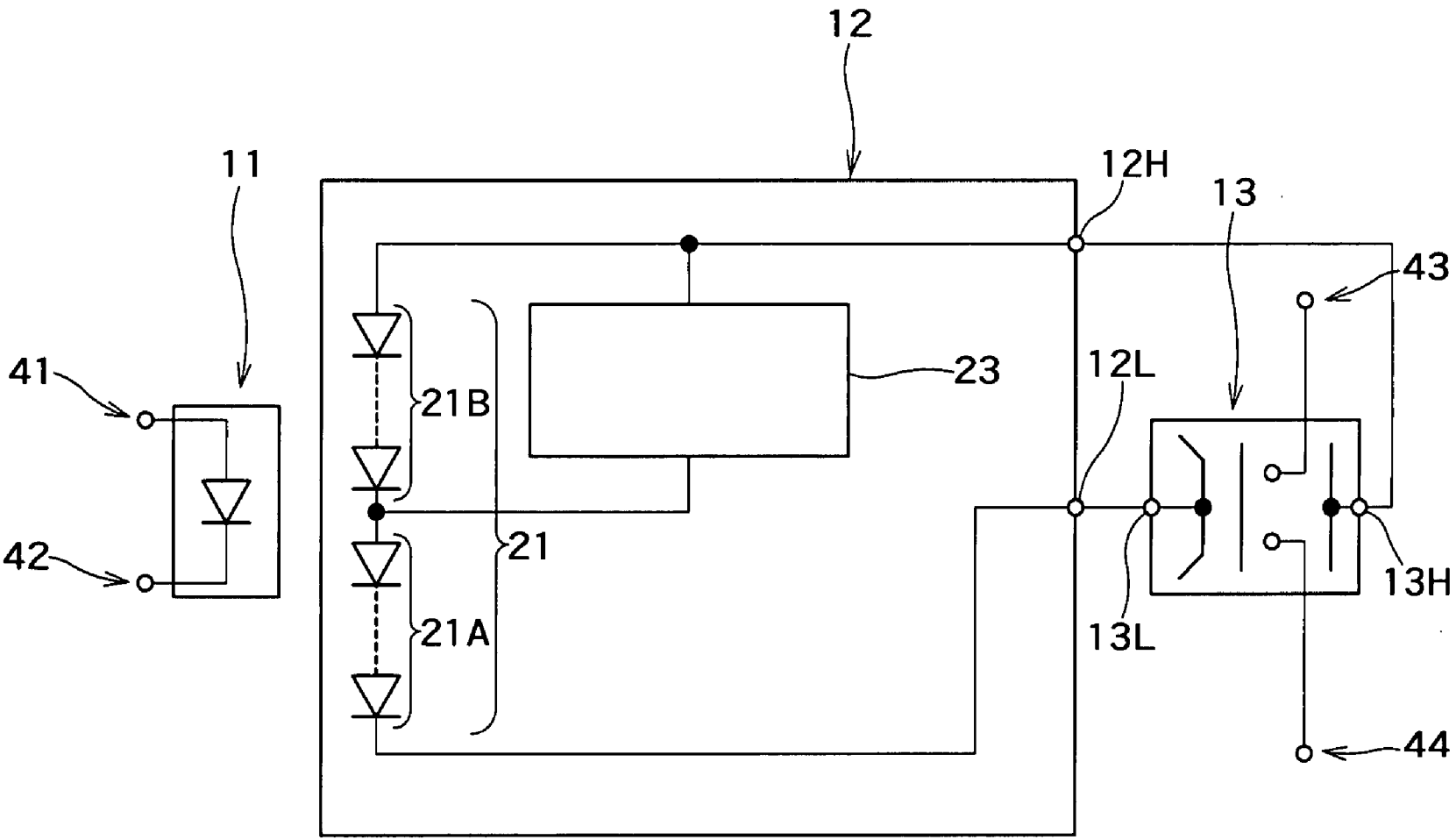
FIG. 1 is a drawing showing a switching device according to a first embodiment of the present invention.

FIG. 1 is a drawing showing a switching device according to a first embodiment of the present invention. This switching device includes a light emitting element 11 connected to a pair of input terminals 41 and 42, a relay circuit (drive circuit) 12, and a mechanical switch contact 13 connected to a pair of output terminals 43 and 44 and driven by static electricity. The light emitting element 11 is an LED. The relay circuit 12 is located so as to be capable of receiving light from the light emitting element 11. The relay circuit 12 includes a photoelectromotive force element 21 which receives light from the light emitting element 11 and generates a photoelectromotive force. The photoelectromotive force element 21 includes a first photodiode array (first array unit) 21A and a second photodiode array (second array unit) 21B, which are connected in series. The first photodiode array 21A includes 40 photodiodes serially connected. The second photodiode array 21B includes 120 photodiodes serially connected. An electronic inductor circuit (bypass circuit) 23 is connected in parallel with the second photodiode array 21B. The photoelectromotive force element 21 including these two photodiode arrays 21A and 21B is connected to a first terminal 12H and a second terminal 12L. The first terminal 12H is connected to a drive electrode 13H located at one side of the switch contact 13. The second terminal 12L is connected to a drive electrode 13L located at the other side of the switch contact 13. In other words, the drive electrode 13H located at one side of the switch contact 13 is connected to an anode side (upper side in the drawing) of the photoelectromotive force element 21, and the drive electrode 13L located at the other side of the switch contact 13 is connected to a cathode side (lower side in the drawing) of the photoelectromotive force element 21. The switch contact 13 is a switch contact using MEMS, which is driven by the relay circuit 12 and is connected to the pair of output terminals 43 and 44.

In the switching device shown in FIG. 1, when an input current flows through the pair of input terminals 41 and 42, the light emitting element 11 emits light. The photoelectromotive force element 21 receives the light from the light emitting element 11, and generates a photoelectromotive force (potential difference) of 0.5 V per one photodiode, i.e., 80 V in total. The potential is higher at the first terminal 12H than the second terminal 12L. Thus, a voltage of 80V is applied to the mechanical switch contact 13 due to the photoelectromotive force. As a result, the mechanical switch contact 13 is turned on, thereby turning on the pair of output terminals 43 and 44. When the LED 13 is turned off, the photoelectromotive force element 21 stops generating the photoelectromotive force, thereby turning off the switch contact 13 to turn off the pair of output terminals 43 and 44. The ON and OFF switching operation of the device of FIG. 4 is performed in this manner.

One of the characteristic features of the relay circuit 12 of the switching device shown in FIG. 1 lies in that the photoelectromotive force element 21 includes the serially connected two photodiode arrays 21A and 21B, and the electronic inductor 23 is connected in parallel with one of them, i.e., the photodiode array 21B. With such a configuration, when the switch contact 13 is driven immediately after the light from the light emitting element 11 reaches the photoelectromotive force element 21, a voltage obtained by combining the voltages of the two photodiode arrays 21A and 21B is applied to the switch contact 13. Accordingly, the switch contact 13 can smoothly start the operation with a high voltage (first voltage) of 80V. Thereafter, when the voltage of the photoelectromotive force element 21 is generated and reaches a steady state, the second photodiode array 21B is shunted (short-circuited) by the electronic inductor 23 connected in parallel thereto. As a result, a low voltage (second voltage) of about 20V from the remaining first photodiode array 21A is applied to the switch contact 13. Thereafter, the low voltage of 20V, which is lower than the voltage at the initial stage of the operation, remains applied to the switch contact 13.

In the switching device and the relay circuit 12 of FIG. 1 described above, after the switch contact 13 starts operating with the high voltage of 80V, the second photodiode array 21B is shunted by the electronic inductor 23. In this manner, it is possible to apply the high voltage of 80 V, which is necessary for a smooth activation of the device, to the switch contact 13 at an initial operation stage, and to change the voltage to the low voltage of 20 V when the switch of the switch contact 13 is held in an ON state. Accordingly, it is possible to increase the lifetime of the switching device and the relay circuit 12 as compared to the case where the high voltage necessary for the activation is maintained after the switch is latched.

Furthermore, in the switch contact 13 of FIG. 1, a voltage of 20 V is sufficient to latch the switch. Accordingly, when the latching voltage is set to be 20 V (low voltage), it is not difficult to latch the switch of the switch contact 13, and degradation of the reliability can be avoided.

Moreover, in the switching device of FIG. 1, the switch contact 13 using MEMS is driven by the relay circuit 12 using the photodiode array 21. Accordingly, it is possible to decrease the size of the relay circuit 12, thereby decreasing the size of the entire device. In addition, it is possible to decrease the cost of manufacturing the relay circuit 12, thereby decreasing the costs of the entire device.

Further, in the switching device of FIG. 1, since the MEMS driven by static electricity is used in the switch contact 13 and a high voltage of 80 V is applied to the switch contact 13 at the initial operation stage, it is possible to obtain a device superior in high-frequency characteristic and high-speed operation.

Thus, according to this embodiment, it is possible to manufacture a switching device and a relay circuit working therefor which are small in size, low in cost, superior in high-frequency characteristic, and long in lifetime.

Next, the range of the high voltage and the low voltage will be discussed. In the aforementioned device, 40 photodiodes are used to form the first photodiode array 21A, and 120 photodiodes are used to form the second photodiode array 21B to generate a high voltage of 80 V at the initial operation stage of the switch contact 13, and a low voltage of 20 V at the latching stage of the switch contact 13. However, it is possible to change values of the high voltage and the low voltage by, e.g., changing the number of the photodiodes. The range of these values will be discussed below.

According to an experiment by the present inventors, when the voltage at the initial operation stage of the switch contact 13 is too low, it becomes difficult to smoothly operate the switch contact 13. On the other hand, when the voltage at the initial operation stage of the switch contact 13 is too high, the lifetime thereof is decreased. Moreover, when the voltage at the latching stage of the switch contact 13 is too low, it becomes difficult to latch the switch, thereby degrading the reliability of the switch. On the other hand, when the voltage at the latching stage of the switch contact 13 is too high, the lifetime is decreased due to the occurrence of sticking. Based on these facts, in the experiment performed by the present inventors, a device with good characteristics was obtained when the low voltage was set to be ¼ or more and ⅔ or less, preferably ¼ or more and ½ or less of the high voltage.

In the aforementioned switching device and the relay circuit 12 of FIG. 1, a circuit using a predetermined time constant can be used as the electronic inductor 23. The size of the electronic inductor 23 can be decreased by using small components such as resistors, capacitors, transistors, etc. to constitute the electronic inductor 23. Furthermore, it is possible to arrange the electric inductor 23 by connecting a resistor and a capacitor in series.

Furthermore, in the relay circuit 12 of FIG. 1, the photoelectromotive force element 21 is constituted by serially connecting the two photodiode arrays 21A and 21B. However, it is possible to constitute it by serially connecting three or more of the photodiode arrays. Moreover, in the relay circuit 12 of FIG. 1, the electronic inductor circuit 23 is connected in parallel with one of the photodiode arrays, 21B, of the photoelectromotive force element 21. However, when the photoelectromotive force element is constituted by serially connecting three or more of the photodiode arrays, it is possible to connect the electronic inductor circuit in parallel with two or more of the photodiode arrays.

[Second Embodiment]

Figure 2:
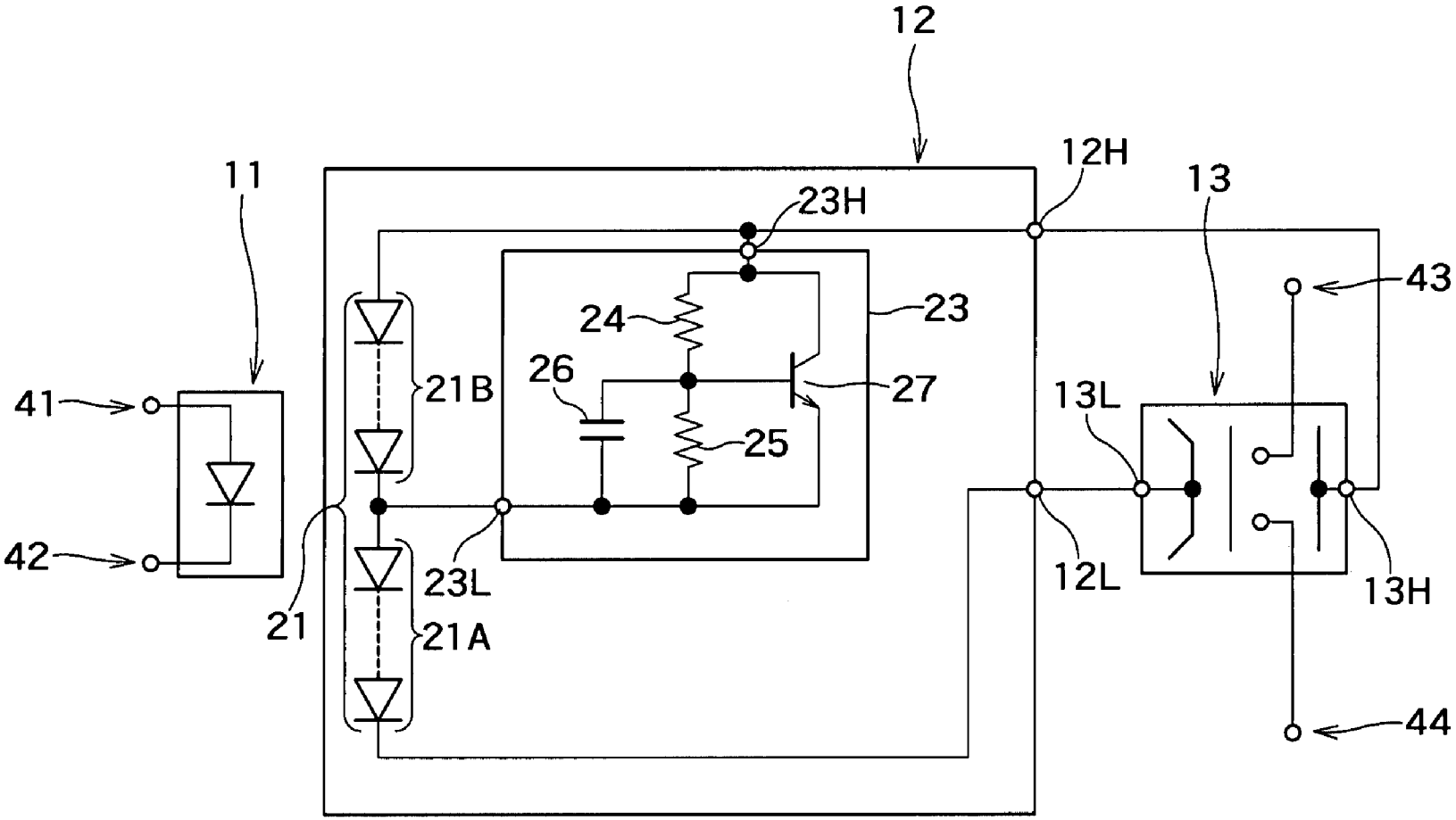
FIG. 2 is a drawing showing a switching device according to a second embodiment of the present invention.

One of the characteristic features of the switching device according to a second embodiment lies in that the electronic inductor 23 is composed of a transistor 27, two resistors 24 and 25, and a capacitor 26, as shown in FIG. 2. The other portions are structured in the same manner as those in the first embodiment, and are assigned the same reference numerals as those in the first embodiment. Hereinafter, the structure of the electronic inductor 23 will be described generally.

FIG. 2 is a drawing showing the switching device according to the second embodiment of the present invention. As in the case of the first embodiment, in this switching device, a switch contact 13 using MEMS is driven by a relay circuit 12 using a photoelectromotive force element (photodiode array) 21. An electronic inductor circuit 23 is connected in parallel to a second photodiode array 21B of the relay circuit 12. In the electronic inductor circuit 23, a first resistor 24 and a capacitor 26 are connected in series between two terminals 23H and 23L. Furthermore, a second resistor 25 is connected in parallel with the capacitor 26. Moreover, the electronic inductor circuit includes an npn type bipolar transistor 27. The collector and the base of the transistor 27 are connected in parallel with the first resistor 24, and the collector and the emitter thereof are connected in parallel with the second resistor 25.

In the switching device of FIG. 2, after a high voltage of 80 V is applied to the switch contact 13, it is possible to change the voltage to about 20 V with a predetermined time constant. The time constant can be easily controlled by adjusting the resistance value R1 of the first resistor 24, the resistance value R2 of the second resistor 25, and the capacitance value C of the capacitor 26. Thus, in the device of FIG. 2, it is possible to easily adjust the time during which the high voltage is applied in accordance with the operation time of the mechanical switch contact 13.

Since the switching device of FIG. 2 includes the transistor 24, it is possible to stabilize the current flow, thereby stabilizing the time constant.

The costs of the resistors 24 and 25, the capacitor 26, and the transistor 27 constituting the electronic inductor 23 of the relay circuit 12 of the switching device shown in FIG. 2 are low. Accordingly, it is possible to curb the costs of manufacturing the device shown in FIG. 2.

[Third Embodiment]

Figure 3:
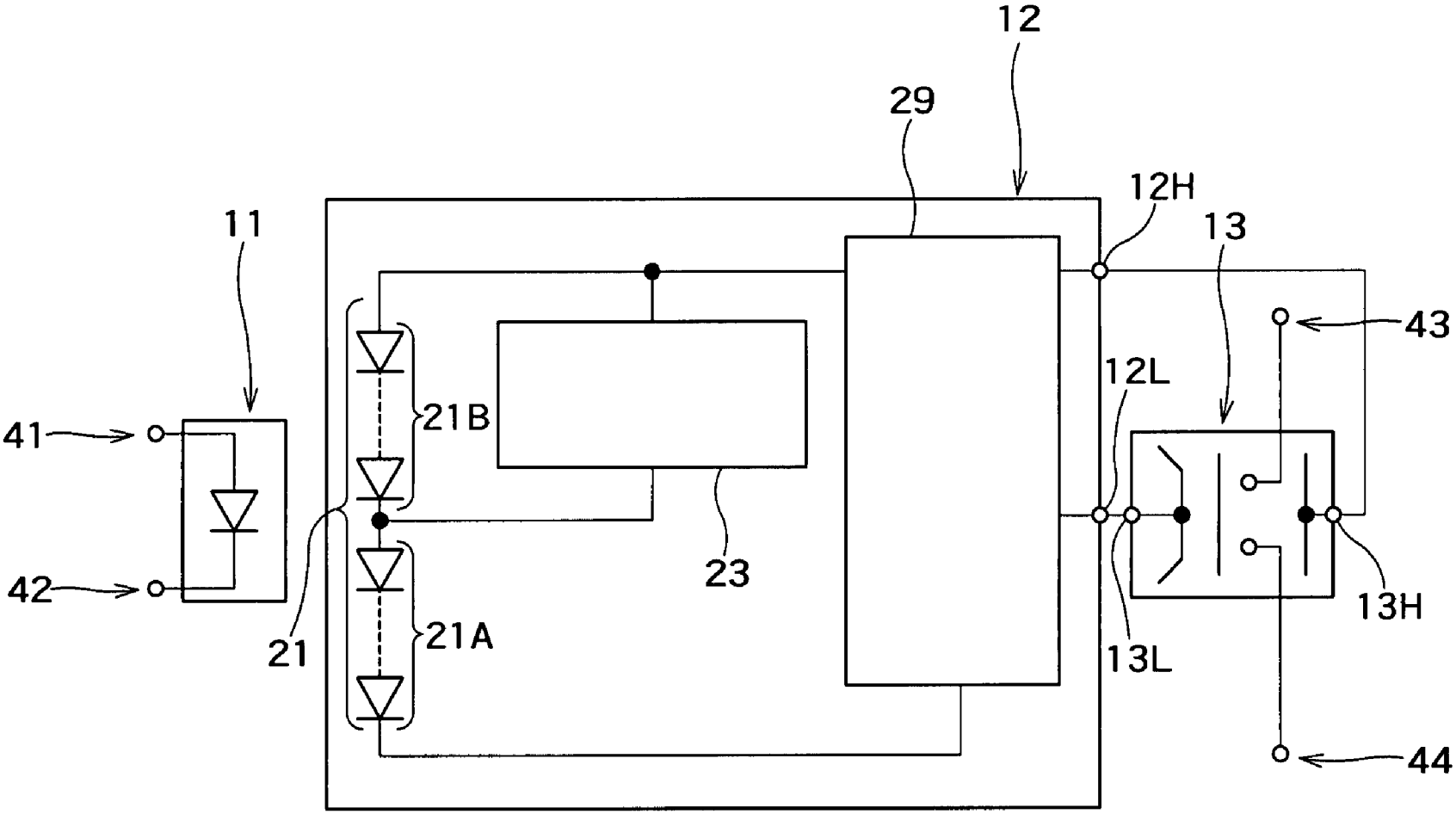
FIG. 3 is a drawing showing a switching device according to a third embodiment of the present invention.

One of the characteristic features of a switching device according to a third embodiment lies in that a relay circuit 12 includes a discharging circuit 29 for discharging the electric charge stored between a drive electrode 13H located at one side of a switch contact 13 and a drive electrode 13L located the other side, as shown in FIG. 3. The other portions are structured in the same manner as those in the first embodiment, and assigned the same reference numerals as those in the first embodiment.

With the discharging circuit 29 for discharging the electric charge stored between the drive electrodes 13H and 13L of the mechanical switch contact 13, as in the case of the third embodiment, it is possible to decrease the time required to recover the switch contact 13.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concepts as defined by the appended claims and their equivalents.

According to the embodiment of the present invention, it is possible to make a switching device which is small in size, low in cost, superior in high-frequency characteristic, and long in lifetime, and a relay circuit used in such a switching device. According to a switching device of the present invention, a mechanical switch contact driven by static electricity is activated by a relay circuit by applying a voltage to the relay circuit using a photoelectromotive force caused by a photodiode array in such a manner that a high voltage is applied until the switch contact is activated, thereafter the voltage is decreased in accordance with the operation of an electronic inductor, and when the switch contact is held in an ON state, a low voltage is applied.

The invention claimed is:

1. A drive circuit of a switch which is mechanical and driven by static electricity, the drive circuit comprising:

a photoelectromotive force element array connected between a first output terminal and a second output terminal connected to the switch, the photoelectromotive force element array including a first array unit and a second array unit, which are serially connected with each other, each of the first array unit and the second array unit having one or more photoelectromotive force elements serially connected, each photoelectromotive force element receiving light to generate a photoelectromotive force; and a bypass circuit connected between the first output terminal and a connection point of the first array unit and the second array unit for bypassing the second array unit to connect the first output terminal and the second output terminal via the first array unit, the bypass circuit being connected between the first output terminal and the connection point so as to be in parallel with the second array unit, and short-circuiting the first output terminal and the connection point a predetermined period of time after the photoelectromotive force is applied from the second array unit.

2. The drive circuit according to claim 1, wherein a voltage generated by the first array unit is ¼ or more and ⅔ or less of a voltage generated by the second array unit.

3. The drive circuit according to claim 1, wherein the bypass circuit is composed of the first and second resistors, a capacitor and a transistor.

4. The drive circuit according to claim 3, wherein the bypass circuit is constituted by connecting the transistor between the first output terminal and the connection point, serially connecting the first resistor and the second resistor between the first output terminal and the connection point, connecting a control terminal of the transistor to a midpoint of the first resistor and the second resistor, and connecting the capacitor between the midpoint and the connection point.

5. The drive circuit according to claim 1, wherein the photoelectromotive force elements are photodiodes.

6. The drive circuit according to claim 1, wherein the bypass circuit is constituted by serially connecting a resistor and a capacitor.

7. The drive circuit according to claim 1, wherein a discharging circuit discharging an electric charge, which is applied when the switch turns off, is connected between the first output terminal and the second output terminal.

8. The drive circuit according to claim 7, wherein the discharging circuit at least includes a resistor.

9. A relay circuit comprising:

a switch, which is mechanical and driven by static electricity; and a drive circuit including a first output terminal and a second output terminal, the switch being connected between the first output terminal and the second output terminal, the drive circuit comprising:

a photoelectromotive force element array including a first array unit and a second array unit, which are serially connected with each other, each of the first array unit and the second array unit having one or more photoelectromotive force elements serially connected, each photoelectromotive force element receiving light to generate a photoelectromotive force; and a bypass circuit connected between the first output terminal and a connection point of the first array unit and the second array unit for bypassing the second array unit to connect the first output terminal and the second output terminal via the first array unit, the bypass circuit being connected between the first output terminal and the connection point so as to be in parallel with the second array unit, and short-circuiting the first output terminal and the connection point a predetermined period of time after the photoelectromotive force is applied from the second array unit.

10. The relay circuit according to claim 9, wherein a voltage generated by the first array unit is ¼ or more and ⅔ or less of a voltage generated by the second array unit.

11. The relay circuit according to claim 9, wherein the bypass circuit is composed of first and second resistors, a capacitor and a transistor.

12. The relay circuit according to claim 11, wherein the bypass circuit is constituted by connecting the transistor between the first output terminal and the connection point, serially connecting the first resistor and the second resistor between the first output terminal and the connection point, connecting a control terminal of the transistor to a midpoint of the first resistor and the second resistor, and connecting the capacitor between the midpoint and the connection point.

13. The relay circuit according to claim 9, wherein the photoelectromotive force elements are photodiodes.

14. The relay circuit according to claim 9, wherein the bypass circuit is constituted by serially connecting a resistor and a capacitor.

15. The relay circuit according to claim 9, wherein a discharging circuit discharging an electric charge, which is applied when the switch turns off, is connected between the first output terminal and the second output terminal.

16. The relay circuit according to claim 15, wherein the discharging circuit at least includes a resistor.

17. The relay circuit according to claim 16, wherein the switch includes a switch contact using MEMS (Micro-Electro-Mechanical System).

18. A relay circuit comprising:

a light-emitting element connected to a pair of input terminals, and emitting light by passing a current between the pair of input terminals;

a switch, which is mechanical and driven by static electricity; and a drive circuit including a first output terminal and a second output terminal, the switch being connected between the first output terminal and the second output terminal, the drive circuit comprising:

a photoelectromotive force element array including a first array unit and a second array unit, which are serially connected with each other, each of the first array unit and the second array unit having one or more photoelectromotive force elements serially connected, each photoelectromotive force element receiving light to generate a photoelectromotive force; and a bypass circuit connected between the first output terminal and a connection point of the first array unit and the second array unit for bypassing the second array unit to connect the first output terminal and the second output terminal via the first array unit, the bypass circuit being connected between the first output terminal and the connection point so as to be in parallel with the second array unit, and short-circuiting the first output terminal and the connection point a predetermined period of time after the photoelectromotive force is applied from the second array unit.

19. The relay circuit according to claim 18, wherein a voltage generated by the first array unit is ¼ or more and ⅔ or less of a voltage generated by the second array unit.

20. The relay circuit according to claim 18, wherein the switch includes a switch contact using MEMS (Micro-Electro-Mechanical System).

* * * * *